US011060367B2

(12) United States Patent
Rakhunde

(10) Patent No.: US 11,060,367 B2
(45) Date of Patent: Jul. 13, 2021

(54) ROTATING CHOKE ASSEMBLY

(71) Applicant: Cameron International Corporation, Houston, TX (US)

(72) Inventor: Vikas Rakhunde, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/704,261

(22) Filed: Dec. 5, 2019

(65) Prior Publication Data

US 2021/0172272 A1 Jun. 10, 2021

(51) Int. Cl.

| | |
|---|---|
| ***E21B 21/08*** | (2006.01) |
| ***E21B 47/06*** | (2012.01) |
| ***E21B 34/06*** | (2006.01) |

(52) U.S. Cl.

CPC ..... *E21B 21/08* (2013.01); *E21B 34/066* (2013.01); *E21B 47/06* (2013.01)

(58) Field of Classification Search

CPC ..... E21B 21/08; E21B 34/066; E21B 47/06; E21B 33/085

See application file for complete search history.

(56) References Cited

U.S. PATENT DOCUMENTS

| | | | | |
|---|---|---|---|---|
| 10,184,296 | B2 | 1/2019 | Niina et al. | |
| 2006/0037744 | A1* | 2/2006 | Hughes | E21B 33/085 166/85.4 |
| 2008/0296016 | A1* | 12/2008 | Hughes | E21B 33/085 166/250.01 |
| 2018/0135366 | A1 | 5/2018 | Olsen et al. | |
| 2019/0055791 | A1 | 2/2019 | Barela | |

FOREIGN PATENT DOCUMENTS

| | | | |
|---|---|---|---|
| WO | 2017096101 | A1 | 6/2017 |

* cited by examiner

*Primary Examiner* — Tara Schimpf
*Assistant Examiner* — Dany E Akakpo

(57) ABSTRACT

A rotating choke assembly includes a rotating control device and a flow control device. The rotating control device has a seal element configured to be disposed around a tubular, where the seal is configured to rotate in a circumferential direction via rotation of the drill string and a bearing configured to facilitate rotation of the seal element in the circumferential direction within a housing of the rotating control device. The flow control device includes a first plate having at least one first opening and a second plate having at least one second opening, where the first plate is configured to rotate in the circumferential direction with respect to the second plate.

20 Claims, 6 Drawing Sheets

ROTATING CHOKE ASSEMBLY

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Oil and natural gas have a profound effect on modern economies and societies. In order to meet the demand for such natural resources, numerous companies invest significant amounts of time and money in searching for, accessing, and extracting oil, natural gas, and other subterranean resources. Particularly, once a desired resource is discovered below the surface of the earth, drilling and production systems are often employed to access and extract the resource. These systems can be located onshore or offshore depending on the location of a desired resource. Such systems may include a drilling fluid system configured to circulate drilling fluid into and out of a wellbore to facilitate the drilling process. In some cases, the drilling fluid may be directed to a platform of the drilling system, where the drilling fluid may be filtered and/or otherwise processed before being directed back into the wellbore. In some cases, a valve, such as a choke valve, is positioned at the surface (e.g., on the platform) and utilized to control a flow of the drilling fluid between the surface and the wellbore. Unfortunately, the valve may have a relatively large footprint, thereby utilizing space that could be used for other components.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
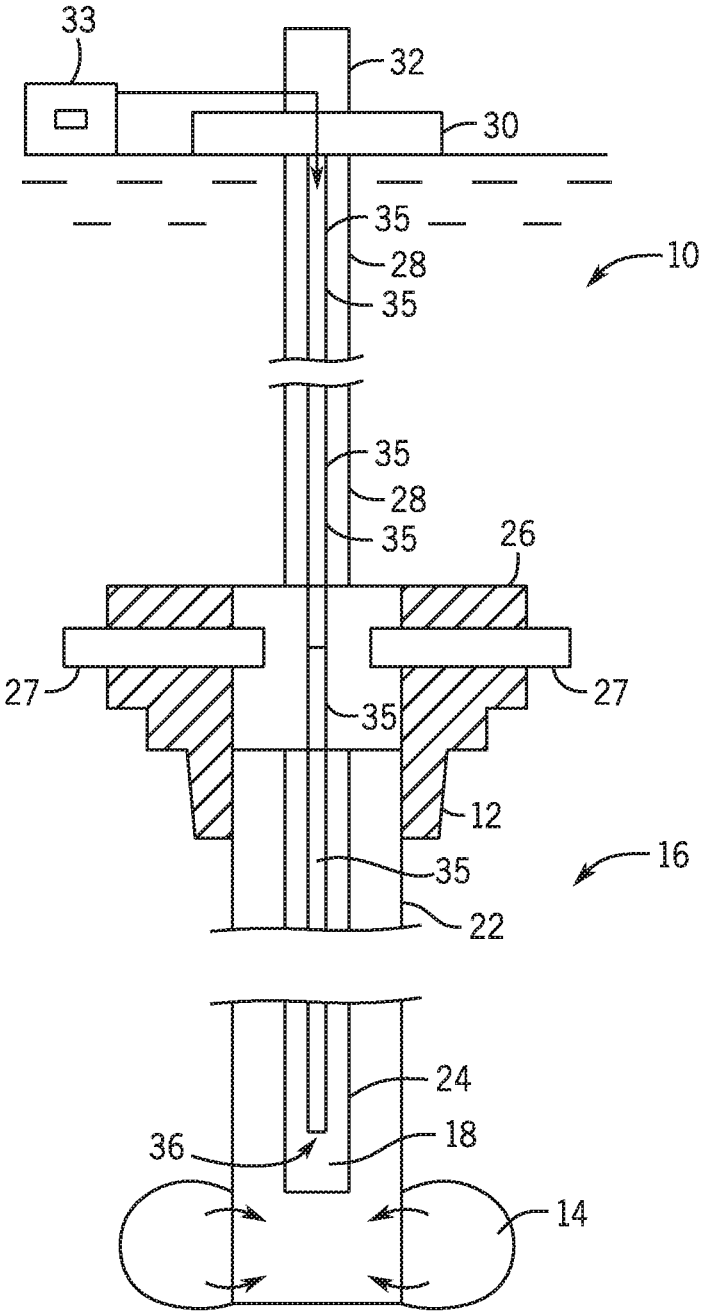
FIG. 1 is a schematic of an embodiment of a drilling system that includes a rotating choke assembly, in accordance with an aspect of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," "said," and the like, are intended to mean that there are one or more of the elements. The terms "comprising," "including," "having," and the like are intended to be inclusive and mean that there may be additional elements other than the listed elements. The use of "top," "bottom," "above," "below," and variations of these terms is made for convenience, but does not require any particular orientation of the components relative to some fixed reference, such as the direction of gravity. The term "fluid" encompasses liquids, gases, vapors, and combinations thereof.

As set forth above, drilling systems may include a valve (e.g., a choke valve) positioned on a platform or otherwise at a surface of a well to control a flow of drilling fluid between the surface and the well. For example, the drilling system may use managed pressure drilling ("MPD") to drill through a sea floor made of softer materials (i.e., materials other than only hard rock). Managed pressure drilling regulates the pressure and flow of mud flowing through an inner drill string, so that the mud flow into the well does not over pressurize the well (i.e., expand the well) or allow the well to collapse under its own weight, for example. The ability to manage the drill mud pressure therefore enables drilling of mineral reservoirs in various locations, including locations with softer sea beds.

In some cases, the drilling system also includes a rotating control device (RCD) that is physically separate from the valve. As used herein, the rotating control device may refer to a system and/or component that forms a seal and/or that blocks fluid flow between the inner drill string and an outer drill string to block a flow of mud, cuttings, and/or natural resources from the well toward the surface. Thus, the rotating control device blocks carbon dioxide ($CO_2$), hydrogen sulfide ($H_2S$), corrosive mud, shallow gas, and/or unexpected surges of material from flowing through the drill string toward the surface. In some cases, the flow of such fluids (e.g., gases, liquids, solids, and/or combinations thereof) may be directed toward another suitable location (e.g., a mud collection tank) other than the surface.

Unfortunately, disposing the valve at the platform or the surface of the well consumes space on the platform and/or the surface. Accordingly, embodiments of the present disclosure are directed to integrating the valve (e.g., a choke valve) into the rotating control device to reduce an amount of space consumed on the platform and/or the surface. The embodiments may also reduce a weight on the platform. For instance, the rotating control device may be modified to include plates (e.g., actuatable plates) that control a flow of fluid through a space (e.g., an annular space) between the inner drill string and the outer drill string. As such, a flow of materials (e.g., mud and/or natural resources) may be controlled within the well instead of at the surface and/or the platform. At least one of the plates may be configured to rotate (e.g., with respect to one another) to adjust a cross-sectional area of overlapping openings extending through the plates. For instance, a flow of the fluid through the plates may increase as the openings extending through the plates further overlap, thereby increasing the cross-sectional area. Similarly, the flow of the fluid through the plates may be reduced as the openings extending through the plates are directed away from one another (e.g., reduced overlap), thereby decreasing the cross-sectional area.

In some embodiments, the plates perform the function of the valve that is disposed at the surface of some drilling systems. Thus, the plates may replace the valve at the surface and/or the drilling systems having the plates may be devoid of the valve at the surface. It should be appreciated that in some embodiments, the plates may be used in conjunction with other valves at the surface and/or the other valves at the surface may be used as a back-up or alternative flow control feature. However, in some embodiments, the plates may reduce the number of valves at the surface.

In operation, one or more of the plates may be rotated (e.g., actuated) via a suitable actuator, such as a motor, hydraulic piston, pneumatic piston, or another suitable drive that adjust the position of the plates with respect to one another. The actuator may be controlled via a control system that adjusts a position of the plate(s) based on feedback received from a sensor. For example, the sensor may monitor a pressure within the well during MPD operations. Thus, the cross-sectional area of overlap between the openings of the plates may be increased as a pressure within the well increases. Similarly, the cross-sectional area of overlap between the openings of the plates may be reduced as the pressure within the well decreases to maintain a pressure within the well at a suitable level. In any case, the valve is integrated into the rotating control device and thus increases an amount of space available at the surface for additional components of the drilling system.

To help illustrate the manner in which the present embodiments may be used in a system, FIG. 1 is a block diagram that illustrates an embodiment of a drilling system 10. The illustrated drilling system 10 can be configured to carry out drilling operations. In some embodiments, the drilling system 10 is land-based (e.g., a surface system) or subsea (e.g., a subsea system). As illustrated, the system 10 includes a wellhead assembly 12 coupled to a mineral deposit 14 via a well 16, wherein the well 16 includes a wellbore 18.

The wellhead assembly 12 typically includes multiple components that control and regulate activities and conditions associated with the well 16. For example, the wellhead assembly 12 generally includes pipes, bodies, valves and seals that enable drilling of the well 16, route produced minerals from the mineral deposit 14, provide for regulating pressure in the well 16, and provide for the injection of drilling fluids into the wellbore 18 (down-hole). For example, FIG. 1 illustrates a conductor 22 (also referred to as "conductor casing") disposed in the well 16 to provide structure for the well 16 and block collapse of the sides of the well 16 into the wellbore 18. One or more casings 24 may be fully or partially disposed in the bore of the conductor 22. The casing 24 also provides a structure for the well 16 and wellbore 18 and provides for control of fluid and pressure during drilling of the well 16. The wellhead 12 may include, a tubing spool, a casing spool, and a hanger (e.g., a tubing hanger or a casing hanger), to enable installation of casing and/or tubing. The system 10 may include other devices that are coupled to the wellhead 12, such as a blowout preventer (BOP) 26 and devices that are used to assemble and control various components of the wellhead 12.

The BOP 26 may include a variety of valves, fittings and controls to block oil, gas, or other fluid from exiting the well in the event of an unintentional release of pressure or an unanticipated overpressure condition. As used herein the term "BOP" may also refer to a "BOP stack" having multiple blowout preventers. The BOP 26 may be hydraulically operated and may close the wellhead assembly 12 or seal off various components of the wellhead assembly 12. During operation of the system 10, a BOP 26 may be installed during removal or installation of additional components, changes in operation of the system 10, or for other reasons. The BOP 26 may be any suitable BOP, such as a ram BOP, an annular BOP, or any combination thereof. The BOP 26 shown in FIG. 1 may be a ram BOP having radially moveable rams 27 configured to close off the bore of the BOP 26 and seal the well 16.

A drilling riser 28 may extend from the BOP 26 to a rig 30, such as a platform or floating vessel. The rig 30 may include various components suitable for operation of the drilling system 10, such as pumps, tanks, power equipment, and any other components. The rig 30 may include a derrick 32 to support the drilling riser 28 during running and retrieval, a tension control mechanism, and any other components.

The drilling riser 28 may carry drilling fluid (e.g., "mud") from the rig 30 to the well 16, and/or may carry the drilling fluid ("returns"), cuttings, or any other substance, from the well 16 to the rig 30. For example, in certain embodiments, the drilling system 10 may include a drilling fluid system 33 that directs the drilling fluid from a source and into the well 16. The drilling riser 28 may also surround a tubular, such as a drill string 35. The drill string 35 may be connected centrally over the bore (such as coaxially) of the well 16, and may provide a passage from the rig 30 to the well 16.

FIG. 1 depicts operation of the drilling system 10 during drilling of the well. As shown in FIG. 1, the drill string 35 extends from the derrick 32 through the BOP 26, through the drilling riser 28, and into the wellbore 18. The drill string 35 may be coupled to a tool (e.g., a drill bit) to aid in drilling the well 16. For example, in one embodiment the drill string 35 may be rotated and/or translated to drill and create the well 16. The drilling fluid may be directed toward an end 36 of the drill string 35 to facilitate movement of the drill string 35 and/or the tool within the well 16. Specifically, the drilling fluid may remove the cuttings and/or other solids from the end 36 of the drill string 35 that may block movement of the drill string 35 and/or the drill bit. Additionally, the drill string 35 may be extended or retracted by adding or removing sections of the drill string 35.

As set forth above, some existing drilling systems may include a valve, such as a choke valve, located at and/or on the rig 30. The valve may control a flow rate of the drilling fluid between the rig 30 and the well 16. However, the valve may include a relatively large footprint, which may reduce an amount of available space at the rig 30 and/or increase a weight at the rig 30. Accordingly, embodiments of the present disclosure are directed toward a rotating choke assembly that enables a flow control device to be integrated into a rotating control device, which may be positioned along the riser 28. For instance, the rotating control device may be disposed along the riser 28 at a position above the BOP 26 (e.g., with respect to the rig 30 and/or an axial length of the drill string 35) to provide a seal (e.g., annular seal) and/or to block fluid flow in an annular space between the drill string 35 and the riser 28. In some embodiments, the rotating control device may be disposed at a position below the BOP 26. The drill string 35 may be rotated in a circumferential direction (e.g., about a central axis of the drill string 35) during drilling operations, and as such, at least a portion of the rotating control device (e.g., a sealing element of the rotating control device) rotates with the drill string 35 and blocks the fluid flow in an annular space formed between the drill string 35 and the riser 28.

In some existing drilling systems, the drilling fluid may flow out of the annular space and through a diverter, conduits, and/or other passageways that are positioned below the rotating control device with respect to the rig 30 and/or the axial length of the drill string 35. As such, in these existing drilling systems, the rotating control device blocks an inadvertent flow of the drilling fluid toward the rig 30. Furthermore, in these existing drilling systems, the drilling fluid flowing through the diverter, conduits, and/or other passageways may ultimately be directed toward the surface and a flow rate of the drilling fluid may be adjusted via the valve located at the surface. It is now recognized that integrating a flow control device into the rotating control device may reduce an amount of space consumed on the rig 30, for example, while maintaining the ability to adjust the flow of the drilling fluid directed toward the surface.

Figure 2:
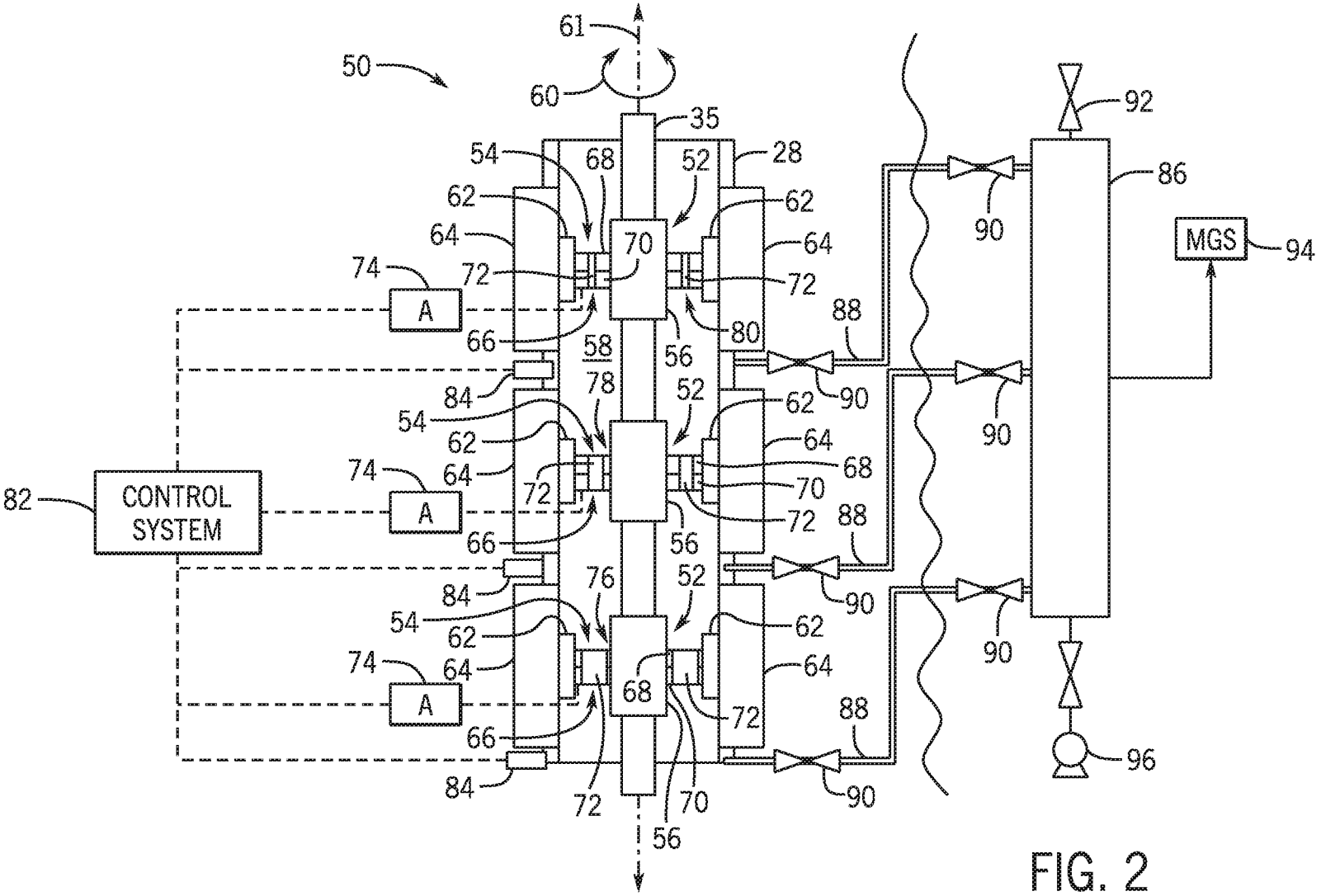
FIG. 2 is a schematic of an embodiment of the rotating choke assembly, in accordance with an aspect of the present disclosure.

FIG. 2 is a schematic of an embodiment of a rotating choke assembly 50 that includes a rotating control device 52 (e.g., RCD) and a flow control device 54. The rotating control device 52 and the flow control device 54 may be integrated into a unitary component. That is, the rotating control device 52 and the flow control device 54 may be positioned within a housing 64 (e.g., annular housing), which may be placed along and/or in line with the riser 28. As shown in the illustrated embodiment of FIG. 2, the rotating control device 52 may include one or more rotating seals 56 (e.g., seal elements) disposed in an annular opening 58 between the drill string 35 and the housing 64. The one or more rotating seals 56 may be configured to rotate in a circumferential direction 60 (e.g., circumferentially about a central axis 61 of the drill string 35) as the drill string 35 rotates in the circumferential direction 60 during drilling operations. In some embodiments, the one or more rotating seals 56 may include a polymeric material (e.g., rubber and/or silicone), an expandable material, a metallic material, or any other suitable material that is configured to generate the seal against the drill string 35 and/or to block fluid flow through the annular opening 58.

In order to facilitate rotation of the seals 56 in the circumferential direction 60, the rotating control device 52 includes one or more bearings 62 that are configured to move (e.g., rotate) relative to the housing 64 of the rotating choke assembly 50. For instance, the drill string 35 may be rotated in the circumferential direction 60, which may cause rotation of the one or more rotating seals 56 and the one or more bearings 62 (e.g., one or more annular bearings) in the circumferential direction 60. The one or more bearings 62 may sealingly engage with the one or more stationary housings 64 (e.g., one or more annular housings) and/or reduce friction between moving components of the rotating control device 52 and the one or more stationary housings 64. In some embodiments, the one or more bearings 62 may include ball bearings, roller bearings, magnetic bearings, and/or another suitable type of bearing.

Further, the rotating choke assembly 50 includes the flow control device 54, which may also rotate in the circumferential direction 60 as a result of rotation of the drill string 35, in some embodiments. The flow control device 54 may be coupled to (e.g., non-rotatably coupled to; to rotate with) the one or more rotating seals 56 of the rotating control device 52. The flow control device 54 may include plates 66 (e.g., actuatable plates) that are configured to adjust a flow of drilling fluid from the well 16 to the rig 30. For example, a first plate 68 of the plates 66 may rotate with respect to a second plate 70 in the circumferential direction 60. The first and second plates 68, 70 may each include orifices and/or openings 72 extending through the first and second plates 68, 70. Rotation of the first plate 68 with respect to the second plate 70 may enable the orifices and/or openings 72 to offset and/or align with one another to control a flow rate of fluid through the annular opening 58 between the drill string 35 and the riser 28. In some embodiments, respective positions of the plates 66 may be adjusted using an actuator 74, such as an electric motor, a hydraulic piston, a pneumatic piston, and/or another suitable drive that rotates one or more of the plates 66 in the circumferential direction 60.

As shown in the illustrated embodiment of FIG. 2, the rotating choke assembly 50 includes three pairs of the plates 66, where each pair includes a corresponding actuator 74. The actuator 74 adjusts the orifices and/or openings extending through the pairs of the plates 66 to adjust a flow rate of fluid through the annular opening 58. Each of the pairs of the plates 66 shown in FIG. 2 includes a different amount of overlap between the orifices and/or openings 72 for illustrative purposes. For example, a first pair 76 of the plates 66 enables a relatively high flow rate of the drilling fluid through the first pair 76 of the plates 66. As such, the orifices and/or openings 72 of the first pair 76 of the plates 66 may overlap significantly with one another to generate a relatively large cross-sectional area for the drilling fluid to flow. A second pair 78 of the plates 66 enables an intermediate flow rate of the drilling fluid through the second pair 78 of the plates 66. As such, the orifices and/or openings 72 of the second pair 78 of the plates 66 may not overlap as much as the first pair 76 of the plates 66 to reduce the flow rate of the drilling fluid 78 through the second pair 78 of the plates 66. Further still, a third pair 80 of the plates 66 enables a relatively low flow rate of the drilling fluid through the third pair 80 of the plates 66. Thus, the orifices and/or openings 72 of the third pair 80 of the plates 66 may be offset from one another and include the smallest amount of overlap when compared to the first pair 76 and the second pair 78 of the plates 66. The plates 66 may be positioned so that the orifices and/or openings 72 do not overlap, and thus, together the plates 66 and the sealing element 56 block the flow of fluid through the annular opening 58 (e.g., seal the annular opening 58)

In some embodiments, the rotating choke assembly 50 may include a control system 82 that is communicatively coupled to the actuator 74 and configured to adjust the respective positions of the actuatable plates 66 based on feedback received from one or more sensors 84. As shown in the illustrated embodiment, the control system 82 is communicatively coupled to the sensors 84, which may be disposed at various locations along the riser 28 (e.g., between adjacent rotating control devices 52). The sensors 84 may include pressure sensors (e.g., pressure transducers), ultrasonic sensors, temperature sensors, flow sensors, and/or any suitable sensors that monitor operating parameters of the drilling fluid within the rotating choke assembly 50. The sensors 84 direct feedback indicative of the operating parameters (e.g., pressure) of the drilling fluid to the control system 82, which may then send one or more command signals to the actuator 74 to adjust a position of one or more of the plates 66 to control the flow rate of the drilling fluid through the annular opening 58.

In some embodiments, such as embodiments configured to utilize managed pressure drilling, the position of the plates 66 may be adjusted based on a pressure within the well 16. For instance, as the pressure within the well 16 increases, the control system 82 may be configured to adjust the plates 66, such that a cross-sectional area of overlap of the orifices and/or openings 72 is increased. Similarly, as the pressure within the well 16 decreases, the control system 82 adjusts the plates 66 to reduce the cross-sectional area of overlap of the orifices and/or openings. As such, a pressure within the well 16 may be substantially maintained via adjustment of the flow control device 54 disposed within the wellbore 18 as opposed to disposed at the surface and/or the rig 30.

Further, the rotating choke assembly 50 may be fluidly coupled to a drilling fluid manifold 86 that is configured to receive the drilling fluid from auxiliary flowlines 88 extending from the riser 28 and/or from the housing 64. For example, each auxiliary flowline 88 may be fluidly coupled to the riser 28 and/or the housing 64, and thus, the annular opening 58. While the housing 64 for each sealing element 56 is shown as a separate structure (e.g., separated from other housings 64 along the riser 28), it should be appreciated that the housing 64 may extend along the riser 28 to circumferentially surround multiple sealing elements 56 and associated components. The auxiliary flow lines 88 may each include one or more respective valves 90 that are configured to adjust a flow rate of the drilling fluid through the auxiliary flow lines 88 and toward the drilling fluid manifold 86. In some cases, the valves 90 are adjusted by the control system 82 based on the feedback from the sensors 84. In other embodiments, the valves 90 are adjusted by the control system 82 (and/or another control system of the drilling system 10) based on feedback from other suitable sensors of the drilling system 10 (e.g., surface sensors and/or downhole sensors). The drilling fluid manifold 86 may be positioned at the rig 30 or otherwise at the surface. As such, the drilling fluid manifold 86 may be configured to direct the drilling fluid toward a pressure relief valve 92, a mud-gas separator 94, and/or a mud pump 96. As should be understood, the drilling fluid may include solids, liquids, and/or gases that may be recycled (e.g., mud), flared (e.g., gas), and/or stored for later use. As such, the rotating choke assembly 50 provides various flow paths for the drilling fluid in addition to the annular opening 58 that enables drilling fluid to flow directly from the well 16 to the rig 30.

While the illustrated embodiment of FIG. 2, illustrates the rotating choke assembly 50 having three rotating control devices 52 and three flow control devices 54, in other embodiments, the rotating choke assembly 50 may include any suitable number of the rotating control devices 52 and the flow control devices 54. For instance, the rotating choke assembly 50 may include one, two, four, five, six, seven, eight, nine, ten, or more than ten of each of the rotating control devices 52 and the flow control devices 54. The number of the rotating control devices 52 and the flow control devices 54 may be based on a pressure capacity of the drilling system 10, a flow rate of the drilling fluid, a size of the well 16, and/or other suitable parameters.

Figure 3:
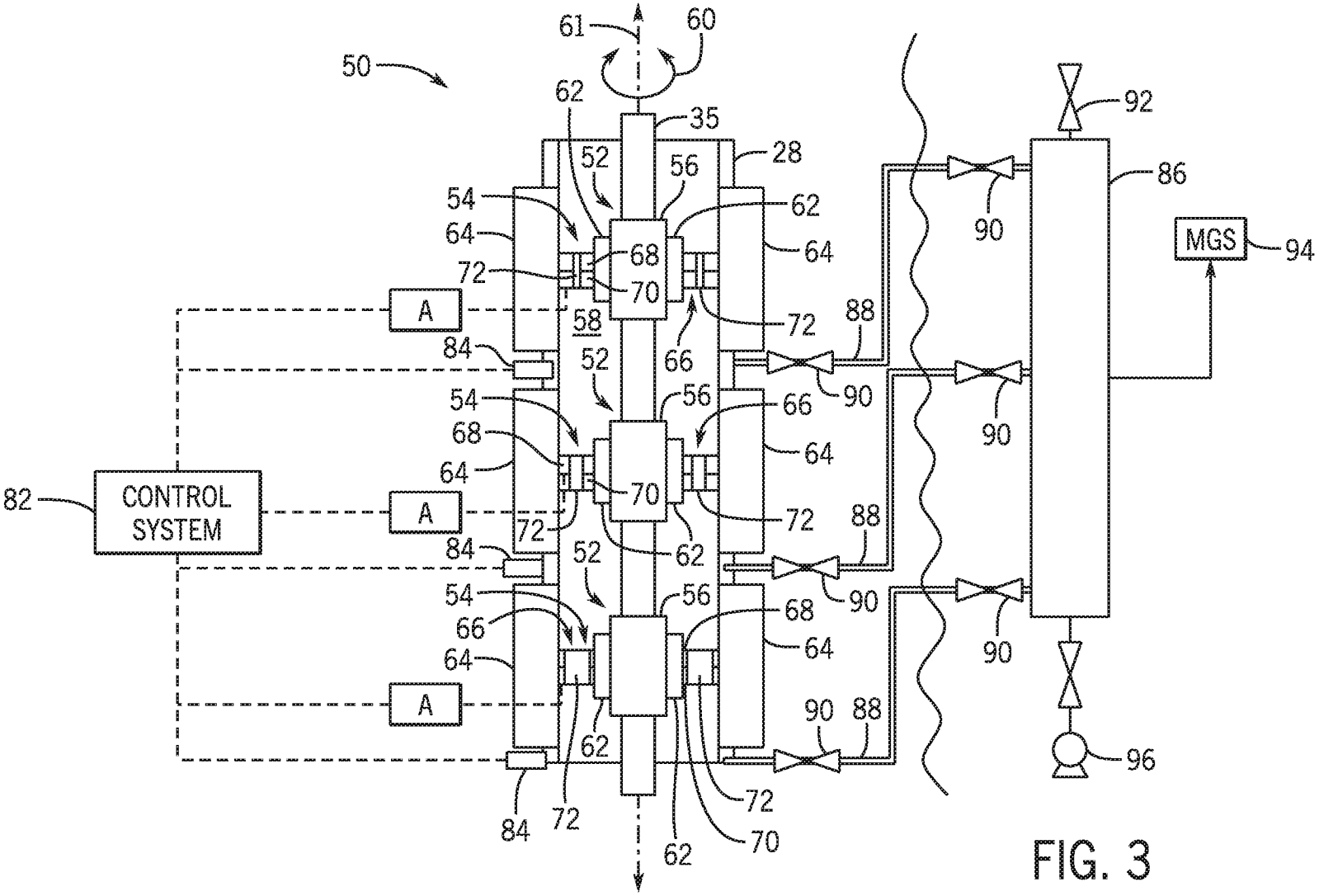
FIG. 3 is a schematic of an embodiment of the rotating choke assembly, in accordance with an aspect of the present disclosure.

FIG. 3 is a schematic of an embodiment of the rotating choke assembly 50, where the one or more bearings 62 are disposed adjacent to the one or more rotating seals 56. In particular, the plates 66 are coupled to and are positioned radially between the housing 64 and the one or more bearings 62, which are positioned radially between the plates 66 and the one or more rotating seals 56. In such embodiments, the plates 66 of the flow control device 54 may remain substantially stationary (e.g., relative to the housing 64; do no rotate with the rotating seals 56) as the drill string 35 rotates in the circumferential direction 60. In other words, the plates 66 do not rotate in the circumferential direction 60 as a result of rotation of the drill string 35 in the circumferential direction 60. In such embodiments, the one or more bearings 62 may reduce friction between the one or more rotating seals 56 and the plates 66 to facilitate rotation of the one or more rotating seals 56 driven by the drill string 35.

Figure 4:
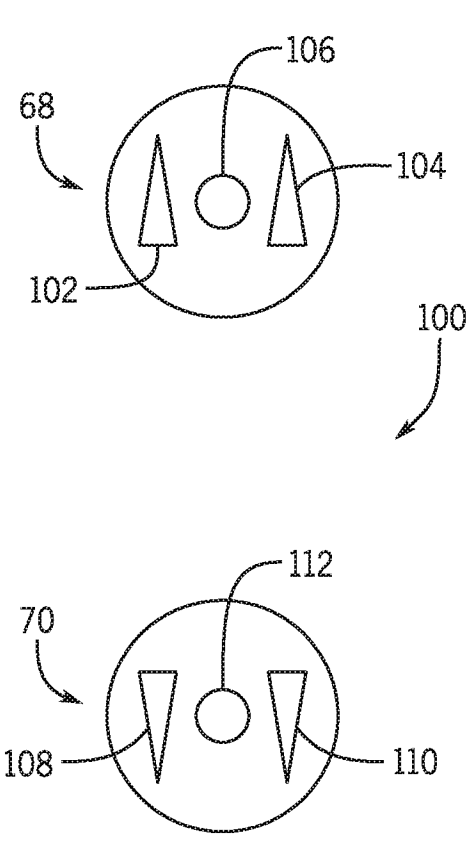
FIG. 4 is a schematic of an embodiment of adjustable plates that may be used in the rotating choke assembly in a first position, in accordance with an aspect of the present disclosure.

FIG. 4 is a plan view of an embodiment of the first plate 68 (e.g., the first actuatable plate) and the second plate 70 (e.g., the second actuatable plate) in a first position 100 (e.g., first configuration; open configuration). As shown in the illustrated embodiment of FIG. 4, the first plate includes a first opening 102, a second opening 104, and a third opening 106. Further, the second plate 70 includes a fourth opening 108, a fifth opening 110, and a sixth opening 112. The third opening 106 and the sixth opening 112 may be configured to receive the drill string 35 and/or the one or more rotating seals 56. For instance, the drill string 35 may extend through the third opening 106 and the sixth opening 112. The one or more rotating seals 56 may be configured to extend through the third opening 106 and the sixth opening 112 and/or otherwise be configured to block a flow of the drilling fluid through the third opening 106 and the sixth opening 112.

In the first position 100, the first opening 102 and the fourth opening 108 may be substantially aligned with one another when the first plate 68 and the second plate 70 are axially aligned with respect to the drill string 35. Further, the second opening 104 and the fifth opening 110 may also be substantially aligned with one another when the first plate 68 and the second plate 70 are in the first position 100. As such, the first and second plates 68, 70 may enable a relatively large flow rate of the drilling fluid through the openings 102, 104, 108, and 110 in the first position 100.

As shown in the illustrated embodiment of FIG. 4, the openings 102, 104, 108, and 110 include a substantially triangular cross-sectional shape. However, in other embodiments, the openings 102, 104, 108, and 110 may include any suitable cross-sectional shape that may enable the first opening 102 and the fourth opening 108, as well as the second opening 104 and the fifth opening 110, to overlap with one another in the first position 100 and to be offset with one another in a second position.

Figure 5:
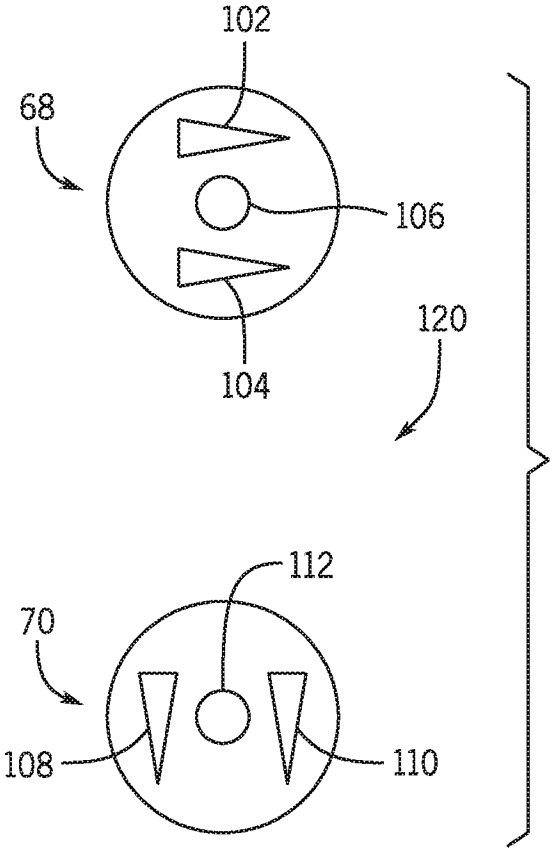
FIG. 5 is a schematic of an embodiment of the adjustable plates that may be used in the rotating choke assembly in a second position, in accordance with an aspect of the present disclosure.

For example, FIG. 5 is a schematic of an embodiment of the first plate 68 and the second plate 70 in a second position 120 (e.g., second configuration; closed configuration). As shown in the illustrated embodiment of FIG. 5, in the second position 120, the first plate 68 is rotated in the circumferential direction 60 approximately 90 degrees from the first position 100. In other embodiments, the second plate 70 may be rotated approximately 90 degrees in the circumferential direction 60 instead of the first plate 68. In still further embodiments, the first plate 68 and/or the second plate 70 may be rotated with respect to one another any suitable amount (e.g., less than 90 degrees, greater than 90 degrees) to cause the first and fourth openings 102, 108 and the second and fifth openings 104, 110 to be offset from one another. In any case, the first opening 102 and the fourth opening 108 are substantially offset from one another, in that a cross-sectional area of overlap between the first opening 102 and the fourth opening 108 is minimized or substantially (e.g., within 10 percent of, within 5 percent of, or within 1 percent of) zero. Further, the second opening 104 and the fifth opening 110 are also substantially offset from one another when the first and second actuatable plates 68, 70 are in the second position 120. As such, a cross-sectional area of overlap between the second opening 104 and the fifth opening 110 is minimized and/or substantially (e.g., within 10 percent of, within 5 percent of, or within 1 percent of) zero.

Therefore, the first position 100 and the second position 120 of the first and second plates 68, 70 may define a maximum flow rate of drilling fluid through the first and second plates 68, 70 and a minimum flow rate of the drilling fluid through the first and second plates 68, 70, respectively. The actuator 74 may be controlled by the control system 82 to adjust the position of the first and/or second plates 68, 70 to any position between the first and second positions 100, 120 based on feedback from the sensors 84 to control the flow rate of the drilling fluid through the annular opening 58 between the drill string 35 and the riser 28. Further, in some embodiments, the size of the openings 102, 104, 108, 110 of the plates 66 may differ between pairs of the plates 66. For example, the first pair 76 of the plates 66 may include the openings 102, 104, 108, 110 having a larger cross-sectional area than the second pair 78 and/or the third pair 80 of the plates 66. As such, the flow rate of the drilling fluid may be further controlled between the pairs 76, 78, 80 of the plates 66.

FIGS. 6-9 are a schematics of embodiments of the first plate 68 and the second plate 70 having the openings 102, 104, 108, 110 with different cross-sectional shapes and/or different orientations. The cross-sectional shapes may enable the first opening 102 and the fourth opening 108, as well as the second opening 104 and the fifth opening 110, to overlap with one another in the first position 100 and to be offset with one another in the second position 120. The third opening 106 and the sixth opening 112 may be configured to receive the drill string 35 and/or the one or more rotating seals 56.

Figure 7:
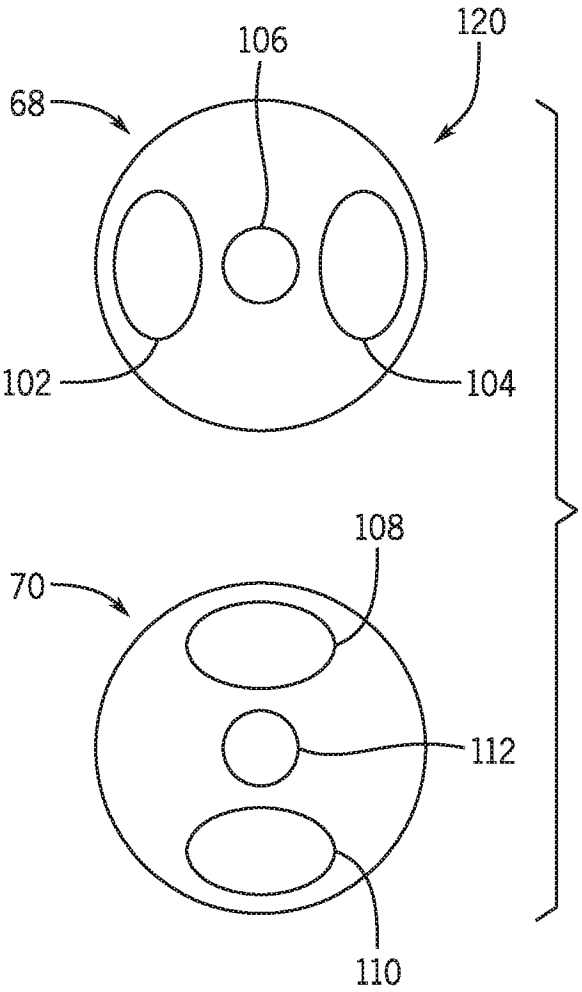
FIG. 7 is a schematic of an embodiment of the adjustable plates that may be used in the rotating choke assembly in the second position, wherein the adjustable plates include openings with a round cross-sectional shape, in accordance with an aspect of the present disclosure.
Figure 6:
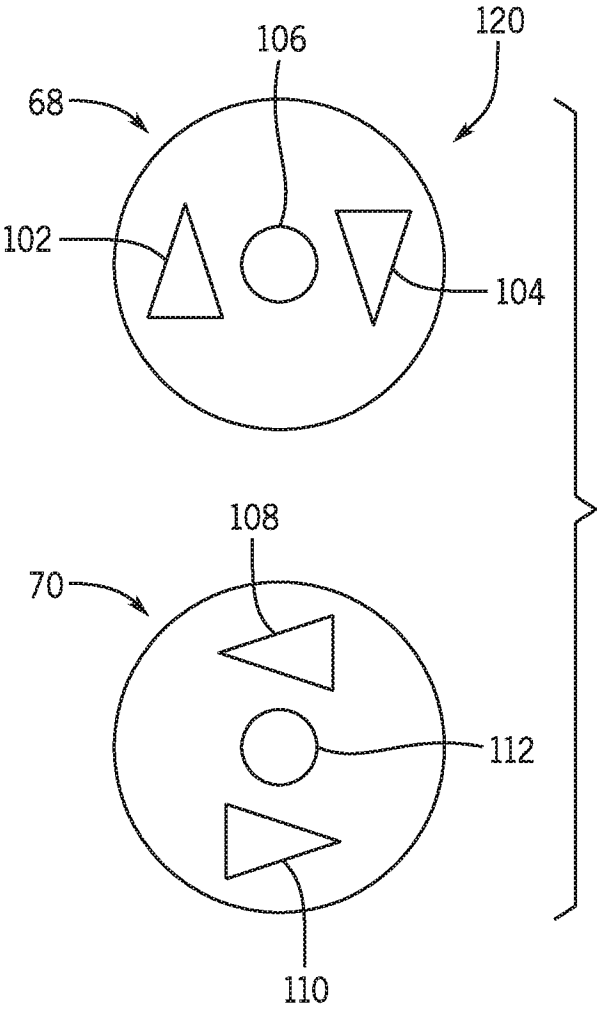
FIG. 6 is a schematic of an embodiment of the adjustable plates that may be used in the rotating choke assembly in the second position, wherein the adjustable plates include openings with a triangular cross-sectional shape, in accordance with an aspect of the present disclosure.
Figure 9:
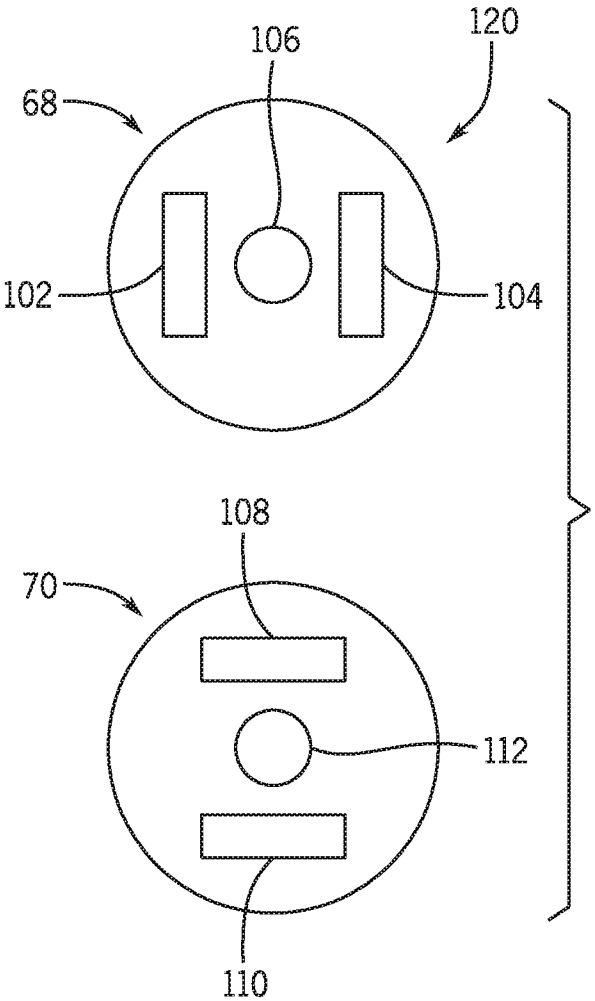
FIG. 9 is a schematic of an embodiment of the adjustable plates that may be used in the rotating choke assembly in the second position, wherein the adjustable plates include openings with a rectangular cross-sectional shape, in accordance with an aspect of the present disclosure.
Figure 8:
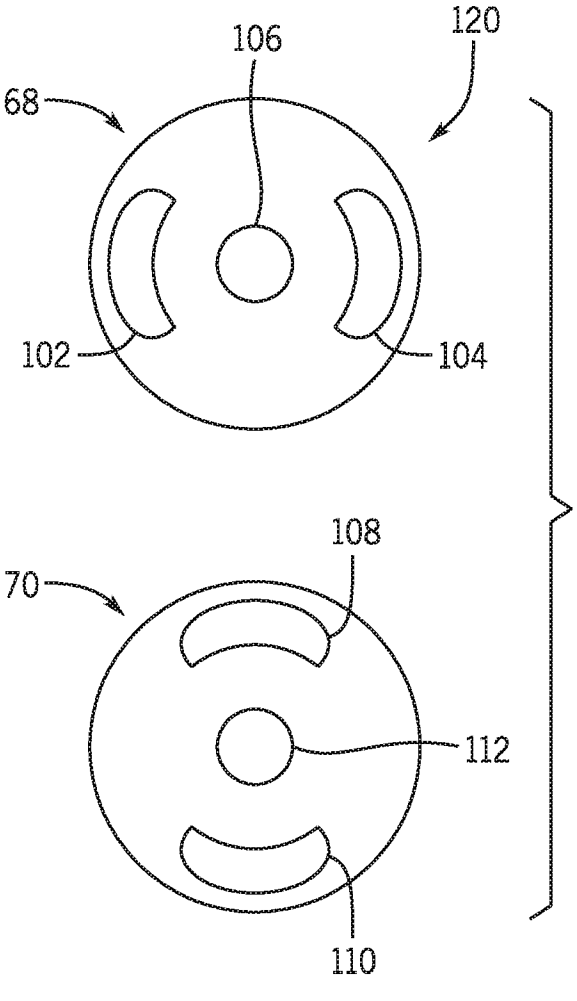
FIG. 8 is a schematic of an embodiment of the adjustable plates that may be used in the rotating choke assembly in the second position, wherein the adjustable plates include openings with a crescent cross-sectional shape, in accordance with an aspect of the present disclosure.

In particular, in FIG. 6, the openings 102, 104, 108, 110 have a triangular cross-sectional shape, but the openings 102, 104 are oriented in a different manner than in FIGS. 4 and 5. For example, a pointed end 120 of the opening 102 is oriented a different way (e.g., opposite) than a pointed end 122 of the opening 104. Similarly, a pointed end 124 of the opening 108 is oriented in a different way (e.g., opposite) a pointed end 126 of the opening 110. In FIG. 7, the openings 102, 104, 108, 110 have a round cross-sectional shape (e.g., ovular). In FIG. 8, the openings 102, 104, 108, 110 have a crescent cross-sectional shape. In FIG. 9, the openings 102, 104, 108, 110 have a rectangular cross-sectional shape. As noted above, the illustrated cross-sectional shapes are merely exemplary, and the openings 102, 104, 108, 110 may have any of a variety of cross-sectional shapes that enable the first plate 68 and the second plate 70 to adjust the flow rate of the fluid across the first plate 68 and the second plate 70.

Embodiments of the present disclosure are directed toward an integrated rotating choke assembly that includes a rotating control device and a flow control device. The rotating choke assembly may include various components that are configured to form a seal between a drill string and a riser of a well. Additionally, the rotating choke assembly is configured to rotate with the drill string during drilling operations to maintain the seal between the drill string and the riser. The flow control device may include at least a pair of plates that each include an opening configured to enable a flow of drilling fluid through an annular opening between the drill string and the riser. A position of the at least one pair of plates may be adjusted using an actuator that is controlled via a control system based on feedback received from various sensors within the well. As such, the rotating choke assembly is configured to control a flow rate of drilling fluid through the annular opening between the drill string and the riser in order to maintain a pressure within the well at various levels, for example.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is intended to cover all modifications, equivalents, and alternatives falling within the spirit and scope of the disclosure as defined by the following appended claims.

The invention claimed is:

1. A rotating choke assembly, comprising:

a rotating control device, comprising:

a seal element configured to seal against a tubular, wherein the seal element is configured to rotate in a circumferential direction via rotation of the tubular; and a bearing configured to facilitate rotation of the seal element in the circumferential direction within a housing of the rotating control device;

a flow control device, comprising:

a first plate comprising at least one first opening; and a second plate comprising at least one second opening, wherein the first plate is configured to rotate in the circumferential direction with respect to the second plate; and an actuator configured to drive rotation of the first plate in the circumferential direction with respect to the second plate.

2. The rotating choke assembly of claim 1, wherein the actuator comprises an electric motor, a hydraulic piston, or a pneumatic piston.

3. The rotating choke assembly of claim 1, comprising a control system configured to control the actuator to drive the rotation of the first plate in the circumferential direction with respect to the second plate based on feedback received from a sensor.

4. The rotating choke assembly of claim 3, comprising the sensor, wherein the sensor is positioned beneath the flow control device with respect to a wellbore.

5. The rotating choke assembly of claim 4, wherein the sensor comprises a pressure transducer.

6. The rotating choke assembly of claim 5, wherein the control system is configured to control the actuator to drive the rotation of the first plate based on the feedback from the pressure transducer, such that a cross-sectional area of overlap between the at least one first opening and the at least one second opening is proportional to the feedback from the pressure transducer.

7. The rotating choke assembly of claim 1, comprising an auxiliary flow line positioned beneath the flow control device and the rotating control device with respect to a wellbore, wherein the auxiliary flow line is configured to direct a flow of drilling fluid from an annular opening between a drill string and a riser to a drilling fluid manifold positioned at a surface of a drilling system.

8. The rotating choke assembly of claim 1, wherein the first plate and the second plate are positioned radially between the housing and the seal element.

9. The rotating choke assembly of claim 1, wherein the first plate and the second plate are coupled to the seal element and are configured to rotate in the circumferential direction with the seal element.

10. A rotating choke assembly for a drilling system, comprising:

a rotating control device, comprising:

a seal configured to seal against a drill string disposed within a well, wherein the seal is configured to rotate in a circumferential direction via rotation of the drill string; and a bearing configured to facilitate rotation of the seal in the circumferential direction within a housing of the rotating control device;

a flow control device, comprising:

a first plate comprising at least one first opening;

a second plate comprising at least one second opening, wherein the first plate is configured to rotate in the circumferential direction with respect to the second plate; and an actuator configured to rotate the first plate in the circumferential direction;

a sensor configured to monitor an operating parameter within the well; and a control system communicatively coupled to the sensor and the actuator, wherein the control system is configured to receive feedback from the sensor indicative of the operating parameter within the well and configured to output a control signal to the actuator to rotate the first plate in the circumferential direction based on the feedback.

11. The drilling system of claim 10, wherein the at least one first opening and the at least one second opening each comprise a substantially triangular cross-sectional area.

12. The drilling system of claim 10, wherein the sensor comprises a pressure transducer and the operating parameter is a pressure within the well.

13. The drilling system of claim 10, wherein the control system is configured to provide the control signal to the actuator to rotate the first plate in the circumferential direction to adjust a cross-sectional area of overlap between the at least one first opening and the at least one second opening based on the feedback.

14. A rotating choke assembly, comprising:

a rotating control device, comprising:

a seal element configured to seal against a tubular, wherein the seal element is configured to rotate in a circumferential direction via rotation of the tubular; and a bearing configured to facilitate rotation of the seal element in the circumferential direction within a housing of the rotating control device;

a flow control device, comprising:

a first plate comprising at least one first opening; and a second plate comprising at least one second opening, wherein the first plate is configured to rotate in the circumferential direction with respect to the second plate; and a control system configured to rotate the first plate in the circumferential direction with respect to the second plate based on feedback received from a sensor.

15. The rotating choke assembly of claim 14, comprising the sensor, wherein the sensor is positioned beneath the flow control device with respect to a wellbore.

16. The rotating choke assembly of claim 15, wherein the sensor comprises a pressure transducer.

17. The rotating choke assembly of claim 16, wherein the control system is configured to rotate the first plate based on the feedback from the pressure transducer, such that a cross-sectional area of overlap between the at least one first opening and the at least one second opening is proportional to the feedback from the pressure transducer.

18. The rotating choke assembly of claim 14, comprising an auxiliary flow line positioned beneath the flow control device and the rotating control device with respect to a wellbore, wherein the auxiliary flow line is configured to direct a flow of drilling fluid from an annular opening between a drill string and a riser to a drilling fluid manifold positioned at a surface of a drilling system.

19. The rotating choke assembly of claim 14, wherein the first plate and the second plate are positioned radially between the housing and the seal element.

20. The rotating choke assembly of claim 14, wherein the first plate and the second plate are coupled to the seal element and are configured to rotate in the circumferential direction with the seal element.

* * * * *